US006360805B1

(12) United States Patent
Takahashi

(10) Patent No.: US 6,360,805 B1
(45) Date of Patent: Mar. 26, 2002

(54) POWER TRANSMISSION DEVICE BETWEEN A FEED REEL AND A TAKE-UP REEL IN A FILM-TRANSFERRING DEVICE

(75) Inventor: Katsuaki Takahashi, Tokyo (JP)

(73) Assignee: Plus Industrial Corporation, Saitama-Ken (JP)

( * ) Notice: Subject to any disclaimer, the term of this patent is extended or adjusted under 35 U.S.C. 154(b) by 107 days.

(21) Appl. No.: 09/610,138

(22) Filed: Jul. 5, 2000

(30) Foreign Application Priority Data

Jul. 27, 1999 (JP) ..... 11-212337

(51) Int. Cl.[7] ..... B32B 31/00

(52) U.S. Cl. ..... 156/540; 156/577; 156/579; 118/257

(58) Field of Search ..... 156/540, 574, 156/577, 579; 118/200, 257

(56) References Cited

U.S. PATENT DOCUMENTS 5,942,036 A * 8/1999 You ..... 118/257
6,062,286 A * 5/2000 Koyama et al. ..... 156/540
6,260,599 B1 * 7/2001 You ..... 167/577
6,270,578 B1 * 8/2001 Murakoshi ..... 118/257
6,325,130 B1 * 12/2001 Kageyama et al. ..... 156/577

FOREIGN PATENT DOCUMENTS

JP 9-2724 1/1997

* cited by examiner

*Primary Examiner*—James Sells
(74) *Attorney, Agent, or Firm*—Darby & Darby

(57) ABSTRACT

In order to provide an inexpensive and compact film-transferring device, the present invention has the following features: In a film-transferring device comprising; a feed reel 1 around which a film-transferring tape a having a film applied to a surface thereof is wound and a take-up reel 2 for taking up used portion a' of said film-transferring tape a, housed in a case body 3; and a film-transferring head 4 projecting outside the case body, for travelling on the film-transferring tape stretched between said two reels 1, 2 while pressing the tape against a film-receiving surface S: the present invention further comprises; a support axis 5 provided in said case body 3; an axial cylinder 7 combined with a reel body 8 to constitute said take-up reel 2 as a whole and rotatably mounted on said support axis 5; a transmissive plate rotatably mounted on said axial cylinder 7; said feed reel being rotatably mounted on said axial cylinder 7 in such manner as to press said reel body 8, via said transmissive plate 6, in the axial direction; the outer diameter of said reel body 8 being larger than that of said feed reel 1 including said film-transferring tape a.

5 Claims, 3 Drawing Sheets

POWER TRANSMISSION DEVICE BETWEEN A FEED REEL AND A TAKE-UP REEL IN A FILM-TRANSFERRING DEVICE

BACKGROUND OF THE INVENTION

1. Field of the Invention

The present invention relates to a power transmission device between a feed reel and a take-up reel in a film-transferring device which comprises; a feed reel around which a film-transferring tape having a film (made of White Out agent or adhesive) applied to a surface thereof is wound and a take up reel for taking up used portion of said film-transferring tape, housed in a case body; a film-transferring head projecting outside the case body, travelling on the film-transferring tape stretched between said two reels while pressing the tape against a film-receiving surface.

2. Prior Art

There has been known, as shown by Japanese Patent Application Laid-Open (Kokai) No.9-2724, a power transmission device wherein a gear is mounted coaxially on each of a feed reel and a take-up reel, and the two gears engages with each other via an intermediate gear, thereby to allow power to be transmitted between the feed reel and the take-up reel.

The prior art, which employs gears, requires that the gears be produced with considerably high accuracy by using expensive molds therefor, and then accuracy of mounting a gear on the feed reel be also high enough to ensure proper performance. Furthermore, the prior art inevitably uses a large number of components, and makes the whole film-transferring device lager than is desired because the gears are disposed, for engagement, on the same plane.

SUMMARY OF THE INVENTION

The present invention has been made in view of the above-mentioned disadvantages; therefore it is an object of the present invention to provide a film-transferring device which is inexpensive and compact.

In order to attain the above object, the present invention has the following features. In a film-transferring device comprising; a feed reel around which a film-transferring tape having a film applied to a surface thereof is wound and a take-up reel for taking up used portion of said film-transferring tape, housed in a case body; and a film-transferring head projecting outside the case body, travelling on the film-transferring tape stretched between said two reels while pressing the tape against a film-receiving surface: the present invention further comprises fundamentally; a support axis provided in said case body; an axial cylinder combined with a reel body to constitute said take-up reel as a whole and rotatably mounted on said support axis; and a transmissive plate rotatably mounted on said axial cylinder; said feed reel being rotatably mounted on said axial cylinder in such manner as to press said reel body, via said transmissive plate, in the axial direction; the outer diameter of said reel body being larger than that of said feed reel including said film-transferring tape. Other advantageous features of the present invention are that the transmissive plate is made of a flexible material having wear resistance properties such as to ensure still better operation of the power transmission; that a surface of the feed reel on the side thereof on which a ridge or a protuberance is provided contacts under pressure with the transmissive plate, which construction helps to provide a durable device; that the ridge is provided on the periphery of the feed reel which runs along a circle having the support axis as its center, thereby ensuring proper operation of the power transmission as well as excellent durability of the device; and that a combination of the feed reel and the transmissive plate is held between the reel body and an engaging claw which is protrusively provided on the peripheral surface of the axial cylinder of the take-up reel, thereby allowing assembly of the device to be simplified and simultaneously enhancing accuracy of the whole device as assembled.

BRIEF DESCRIPTION OF THE DRAWINGS

The accompanying drawings illustrate by way of example one manner in which a power transmission device between a feed reel and a take-up reel in a film-transferring device according to the present invention may be carried into practice.

DETAILED DESCRIPTION OF THE PREFERRED EMBODIMENT

Figure 1:
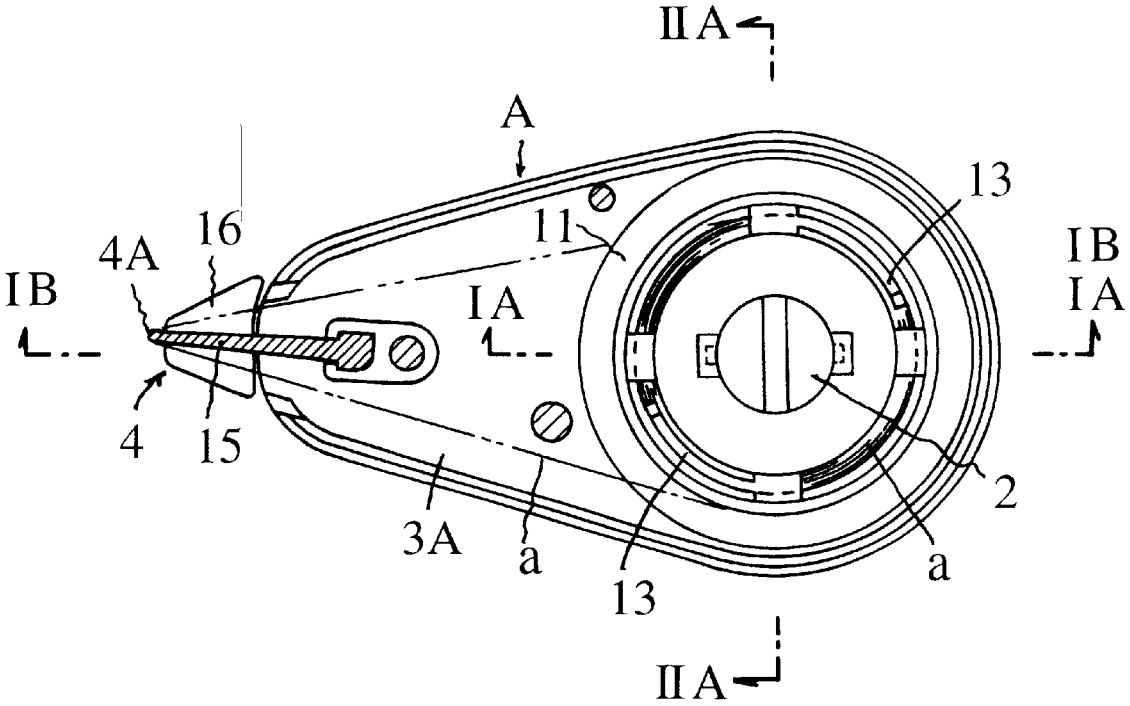
FIG. 1 shows a front elevational view of the device, with a part thereof omitted.
Figure 3:
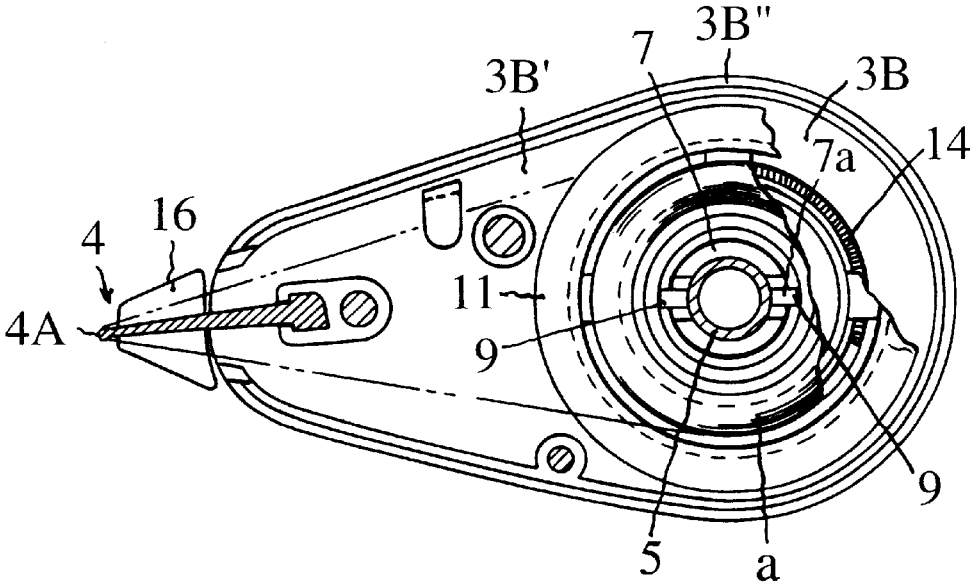
FIG. 3 shows a rear elevational view thereof, with a part thereof omitted.

The present invention will be described below with reference to the embodiment illustrated in the accompanying drawings.

The film-transferring device A according to the embodiment comprises; a feed reel 1 around which a film-transferring tape a having a film applied to a surface thereof is wound and a take-up reel 2 for taking up used portion a' of said film-transferring tape a, housed in a case body 3; a film-transferring head 4 projecting outside the case body 3, travelling on the film-transferring tape a stretched between said reels 1 and 2 while pressing the tape a against a film-receiving surface S; a cylindrical support axis 5 provided at a rear portion of a base cover 3A of said case body 3; said take-up reel 2 being combined with said feed reel 1 and mounted on said support axis 5, with a transmissive plate 6 sandwiched between the two reels 1 and 2.

Figure 2:
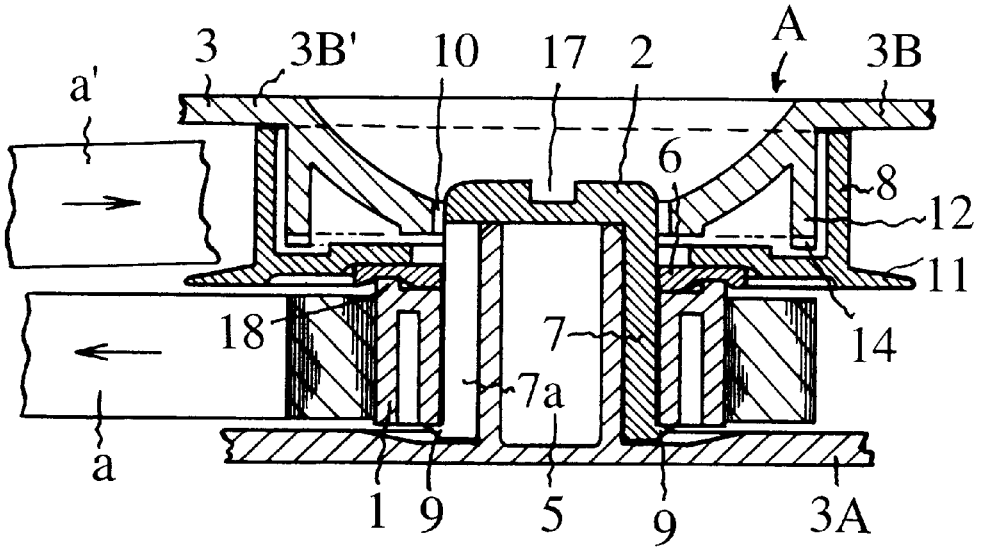
FIG. 2 shows an enlarged cross-sectional view thereof taken along line IA—IA indicated in FIG. 1.
Figure 4:
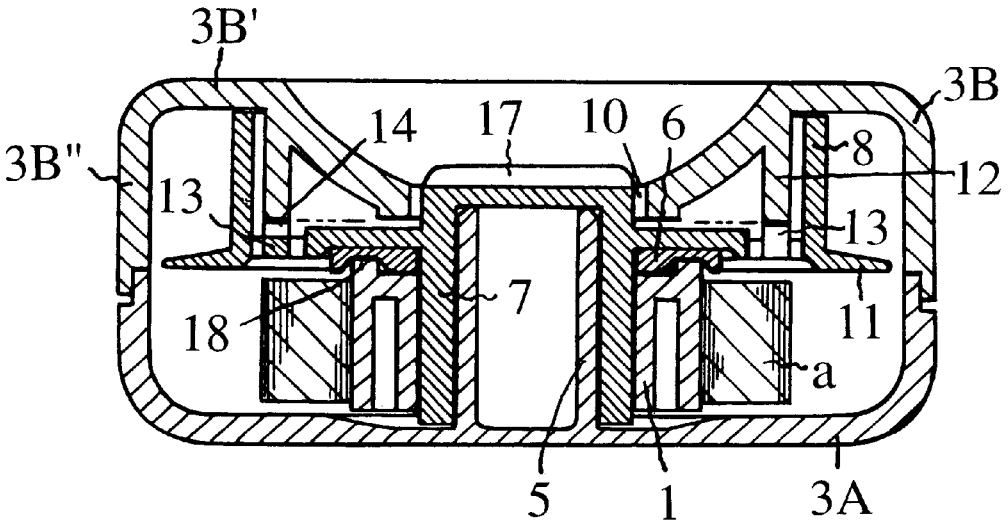
FIG. 4 shows an enlarged cross-sectional view thereof taken along line IIA—IIA indicated in FIG. 1.
Figure 5:
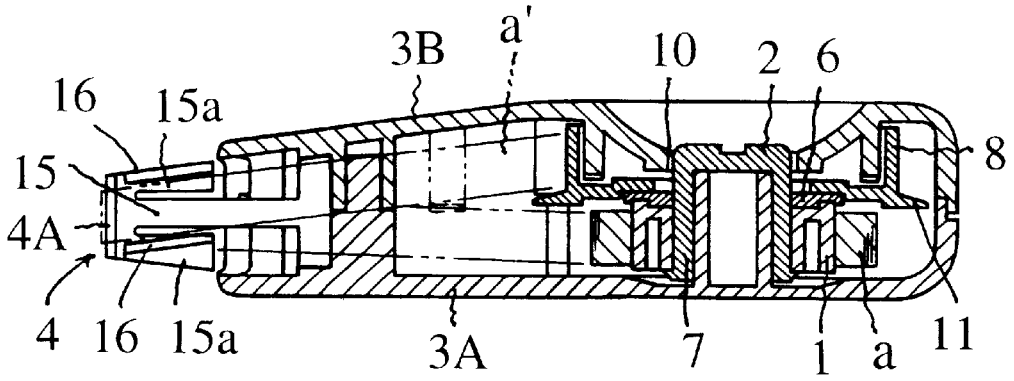
FIG. 5 shows a cross-sectional view thereof taken along line IB—IB indicated in FIG. 1.

The take-up reel 2 comprises an axial cylinder 7 and a reel body 8, each in the shape of a cylinder having a bottom portion thereof, constituted as one unitary body in manner that the axial cylinder 7 is located in the center of the reel body 8 (, with an opening of the reel body 8 facing in the opposite direction to an opening of the axial cylinder 7). Formed at opposing positions in the axial cylinder 7 is a pair of slits, in which fitting members 7*a*, 7*a* are provided in manner that elastic transformation of the fitting members 7*a*, 7*a* helps to allow themselves to fit perfectly into the axial cylinder 7. Each of the fitting members 7*a*, 7*a* has an engaging claw 9 at its free end (its lower end, seen in FIG. 2). Said transmissive plate 6 and said feed reel 1 are mounted on an outer surface of said axial cylinder 7. The feed reel 1 presses, via the transmissive plate 6, said reel body 8 in the axial direction of the axial cylinder 7. This pressing condition is maintained by having the feed reel 1 and the transmissive plate 6 held between the engaging claws 9, 9 and the reel body 8.

The bottom portion (the top surface, seen in FIG. 2) of the axial cylinder 7 is exposed outside the case-body 3 through a window 10 provided in a lid cover 3B detachably mounted on said base cover 3A thereby to constitute said case body 3 as a whole. In the bottom surface of the axial cylinder 7 cut is a groove 17 in which a tool is to engage.

Even when the tape a once tensioned has slackened for some cause, it is possible to easily amend the slackness by turning the take-up reel 2 with a tool engaged in the groove 17.

Said reel body 8, which is integrally attached to the axial cylinder 7 so as to constitute the take-up reel 2 as a whole, has an outer diameter larger than that of the feed reel 1 including the film-transferring tape a (, that is, larger than the outer diameter of the feed reel 1 in the state of the tape a being wound up around the feed reel 1). Said lid cover 3B comprises a main plate 3B' and a peripheral wall plate 3B" perpendicularly provided on the peripheral end of the main plate 3B'. The reel body 8 is provided with a flange 11 whose upper surface faces the main plate 3B'. A take-up operation is smoothly performed, with used portion a' of the film-transferring tape a being taken up between said flange 11 and said main plate 3B'. From the main plate 3B' protrudes a cylindrical member 12, onto which the reel body 8 is fitted.

The reel body 8 is further provided with a pair of claw members 13, 13 made by cutting slits on an arc about the axial cylinder 7 or the support axis 5. The claw members 13, 13 engage with ratchet teeth 14 provided on the cylindrical member 12. This construction allows the reel body 8 to turn only in the take-up direction.

Said feed reel 1 has a ridge 18 provided on the periphery of a surface thereof which faces toward the take-up reel 2. The transmissive plate 6 is held between said ridge 18 and the take-up reel 2 in such manner that the ridge 18 presses the transmissive plate .6 stronger than any other portion of said surface does. That is, a part of the transmissive plate 6 is strongly compressed by the ridge 18 of the feed reel 1, with the other part thereof (the inside portion surrounded by the ridge 18) slightly compressed. This enables fine-tuning of the slippage torque by metal mold adjustment (especially fine-tuning of height of the inside portion). The heavily loaded portion (which contacts with the ridge 18) varies with time rather easily, while the lightly loaded portion (which does not contact with the ridge 18) does not vary with time easily. When the slippage torque of the former declines with time, then the latter ensures provision of another slippage torque. In this connection, even a slight dimensional error (in the range of ±0.05 mm) that might happen in molding the transmissive plate 6 does not cause any serious decline of torque in connection with proper operation of the product.

It is desirable that the transmissive plate 6 be made of such material as is flexible and does not transform or wear easily in spite of long-time compression. For this material, it is possible to employ polystyrene, felt, nylon, polyester, leather, synthetic leather, wool or the like. However, the material is not necessarily limited to them, because any material will do if it is capable of providing frictional resistance for both the feed reel 1 and the take-up reel 2 while being sandwiched between the reels 1 and 2.

Furthermore, the ridge 18 could be provided partially like an arc or like dotted line on the periphery of the feed reel 1; and its location is not limited to the periphery thereof.

From the case body 3 protrudes a flexible stem member 15 whose root is secured in the case body 3. The distal end portion of the stem member 15 is shaped roundly such as to provide a pressing portion 4A of the film-transferring head 4, for pressing the film-transferring tape a. Behind the pressing portion 4A, wings 15*a*, 15*a* are provided in manner that the wings 15*a*, 15*a* are connected to either side of the stem member 15, with a slit between each wing 15*a* and the stem member 15. On side edges of said wings 15*a*, 15*a*, guide members 16, 16 for guiding the film-transferring tape a are provided in a crossing direction to the wings 15*a*, 15*a*.

The film-transferring device A is assembled as follows. Firstly, the feed reel 1 and the transmissive plate 6 are placed about the support axis 5 in the base cover 3A of the case body 3 in manner that both of the feed reel 1 and the transmissive plate 6 surround the support axis 5. Secondly, while the film-transferring tape connected between the feed reel 1 and the take-up reel 2 is being brought into engagement with the pressing portion 4A of the film-transferring head 4, the axial cylinder 7 of the take-up reel 2 is forcibly pushed in between the support axis 5 and the combination of the transmissive plate 6 and the feed reel 1, with the fitting members 7*a*, 7*a* in the axial cylinder 7 transformed elastically; thereby allowing the engaging claws 9, 9 formed at the end of the fitting member 7*a* to engage with one of the surfaces of the feed reel 1, and simultaneously allowing the combination of the transmissive plate 6 and the feed reel 1 to be held between the reel body 8 and the engaging claws 9, 9, with the transmissive plate 6 compressed. These three members are assembled in the base cover 3A, and then the lid cover 3B is mounted on the base cover 3A in manner that the location of the window 10 corresponds to that of the axial cylinder 7.

Figure 6:
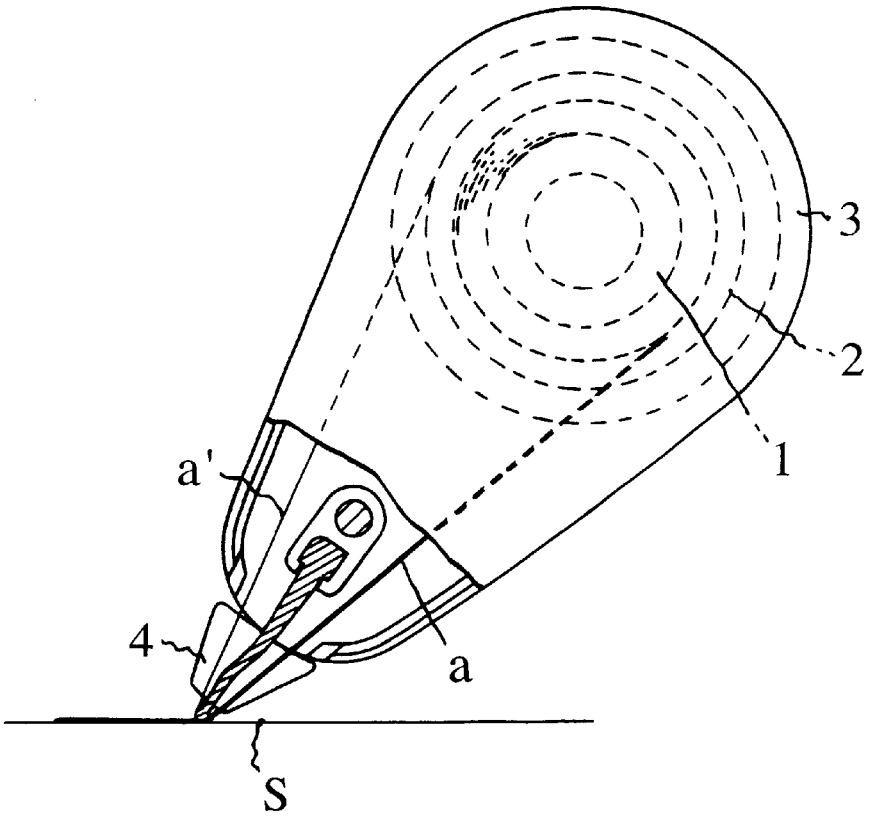
FIG. 6 shows a front view thereof in the state of use, with a part thereof omitted.

Referring to FIG. 6, the film-transferring device is moved rightward, with the film-transferring tape a pressed against a film-receiving surface S by the film-transferring head 4, thereby to transfer the firm applied to the tape a to said film-receiving surface S. In the film-transferring operation, travel of the film-transferring head 4 on the film-transferring tape a forces the tape a to be fed from the feed reel 1, and simultaneously forces used portion a' of the tape a to be absorbed by and wound around the take-up reel 2. During the film-transferring operation, the film-transferring tape a is being tensioned between the feed reel 1 and the take-up reel 2 via the film-transferring head 4 (If the tape a is not in such a tensioned condition, it is possible to tension it by turning the axial cylinder 7 or the take-up reel 2 through the groove 17.), and the outer diameter of the take-up reel 2 is always larger than that of the feed reel 1. The travel of the film-transferring head 4 on the film-transferring tape a synchronizes with feeding of the tape a from the feed reel 1. Under this condition, the feed reel 1 turns about the support axis 1 via the axial cylinder 7, thereby feeding the tape a.

Since the film-transferring tape a is, as described above, in a tensioned condition when it begins to be fed, the feed reel 1 not only feeds the film-transferring tape a while turning, but also simultaneously transmits its turning force to the take-up reel 2 via a transmissive plate 6, thereby ensuring that the take-up reel 2 is forced to turn to take up just as much amount of tape as the feed reel 1 feeds. If the amount (length) of the tape a' being taken up by the take-up reel 2 is not identical with that of the tape a being fed by the feed reel 1, the tape is torn up, or is not taken up properly. In order to avoid such troubles, (the embodiment of) the present invention has the following features. In the structure that the take-up reel 2 is always larger than the feed reel 1 in outer diameter, the transmissive plate 6 is employed as a member for providing frictional resistance between the two reels 1, 2, thereby enabling the film-transferring operation to be performed in manner that the driving force (turning force) of the feed reel 1 is transmitted to the take-up reel 2 via the transmissive plate 6, and the,amount of the tape being taken up is kept identical with that of the tape being fed, with the take-up reel 2 reducing the number of rotation thereof appropriately. In this manner, the film-transferring operation is performed repeatedly.

The present invention, which is constructed as mentioned above, has made it possible to reduce the number of components as compared with the prior art, thereby ensuring easier management of the components and reduction of the time needed to assemble the whole device. Furthermore, according to the present invention, there is no such backlash as might be caused if gears were provided in the device. Therefore, the present invention provides a novel device based on the aforesaid innovative construction, and has now been successful in downsizing the film-transferring device drastically.

What is claimed is:

1. In a film-transferring device comprising; a feed reel around which a film-transferring tape having a film applied to a surface thereof is wound and a take-up reel for taking up used portion of said film-transferring tape, housed in a case body; and a film-transferring head projecting outside the case body, travelling on the film-transferring tape stretched between said two reels while pressing the tape against a film-receiving surface:

a power transmission device between the feed reel and the take-up reel in the film-transferring device, comprising; a support axis provided in said case body; an axial cylinder combined with a reel body to constitute said take-up reel as a whole and rotatably mounted on said support axis; a transmissive plate rotatably mounted on said axial cylinder; said feed reel being rotatably mounted on said axial cylinder in such manner as to press said reel body, via said transmissive plate, in the axial direction; the outer diameter of said reel body being larger than that of said feed reel including said film-transferring tape.

2. A power transmission device between the feed reel and the take-up reel in the film-transferring device as claimed in claim 1, wherein said transmissive plate is made of a flexible material having wear resistance properties.

3. A power transmission device between the feed reel and the take-up reel in the film-transferring device as claimed in claim 2, wherein a surface of the feed reel on the side thereof on which a ridge or a protuberance is provided contacts under pressure with the transmissive plate.

4. A power transmission device between the feed reel and the take-up reel in the film-transferring device as claimed in claim 3, wherein said ridge is provided on a periphery of the feed reel which runs along a circle having the support axis as its center.

5. A power transmission device between the feed reel and the take-up reel in the film-transferring device as claimed in claim 1, wherein a combination of the feed reel and the transmissive plate is held between the reel body and an engaging claw which is protrusively provided on the peripheral surface of the axial cylinder of the take-up reel.

* * * * *